US007887373B1

(12) United States Patent
Wang

(10) Patent No.: US 7,887,373 B1
(45) Date of Patent: Feb. 15, 2011

(54) CONNECTOR SOCKET

(75) Inventor: Gang Wang, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/650,015

(22) Filed: Dec. 30, 2009

(51) Int. Cl.
*H01R 27/00* (2006.01)

(52) U.S. Cl. ..... 439/660; 439/218

(58) Field of Classification Search ..... 439/218, 439/660

See application file for complete search history.

(56) References Cited

U.S. PATENT DOCUMENTS 6,464,542 B1 * 10/2002 Lee ..... 439/680
6,482,045 B2 * 11/2002 Arai ..... 439/680
6,712,643 B2 * 3/2004 Suzuki ..... 439/500
6,776,653 B1 * 8/2004 Hsiao ..... 439/541.5
7,513,801 B2 * 4/2009 Cheng et al. ..... 439/638
7,517,253 B1 * 4/2009 Chiang ..... 439/660
7,727,027 B2 * 6/2010 Chiang et al. ..... 439/660
2005/0186843 A1 * 8/2005 Tsai ..... 439/607
2009/0186528 A1 * 7/2009 Chen ..... 439/660

* cited by examiner

*Primary Examiner*—Briggitte R Hammond
(74) *Attorney, Agent, or Firm*—Rosenberg, Klein & Lee

(57) ABSTRACT

A connector socket for engaging with a first plug and a second plug with different widths is disclosed. The connector socket includes an insulation base, and a metal casing embracing the insulation base. A first engagement space and a second engagement space are defined. The first plug occupies the first engagement space after entering the metal casing. The second plug occupies the first engagement space and the second engagement space after entering the metal casing. The connector socket further includes an elastic device mounted in the insulation base and partially extends into the second engagement space. When the first plug enters the first engagement space, the elastic device leans against a side of the first plug close to the second engagement space. When the second plug enters the first engagement space and the second engagement space, the elastic device leans against a top surface of the second plug. A top sidewall of the metal casing could stop the elastic device. Thereby, the elastic device could be prevented from being excessively deformed.

9 Claims, 10 Drawing Sheets

CONNECTOR SOCKET

BACKGROUND OF THE INVENTION

1. Field of the Invention

This invention relates to a connector socket, and more particularly, relates to a connector socket capable of providing good engagement and positioning for a first plug and a second plug with different widths.

2. Description of the Prior Art

Since electronic products were presented to the public and as the society develops and progresses, the electronic products develop toward being light, thin, small, and portable at a quicker speed under the development tendency of technique. In the industry, ports of various peripheral apparatuses are commonly integrated into a connector socket. The various peripheral apparatuses could be connected to a computer through the single connector socket. Especially, ports of two plugs with different widths are integrated into a connector socket. Because of the different widths of the engagement portions of the plugs, disposition of an elastic device usually realizes a good engagement between the plugs and the socket. However, under the effect of the magnitude of the loading and other factors during the engagement, it is inevitable for the elastic device to be beyond the elastic limit to be distorted and deformed, which affects the engagement effect.

There is a connector socket currently. Please refer to FIG. 1. The connector socket includes a casing A0, a body B0 accommodated in the casing A0, and a plurality of terminals B1 disposed therein. The casing A0 is hollow and forms a accommodating room C0 inside. The accommodating room C0 has an opening C1. The casing A0 includes a limit spring sheet A1 formed by cutting the casing A0 and protruding axially at the edge of the opening C1.

The connector socket is used for engaging with a display port ("DP" for short hereinafter) plug D0 and a high definition multimedia interface ("HDMI" for short hereinafter) plug E0. The DP plug D0 includes a first engagement part D1. The HDMI plug E0 includes a second engagement part E1. The width of the first engagement part D1 is wider than that of the second engagement part E1. When the first engagement part D1 is inserted into the accommodating room C0 of the connector socket, two sidewalls of the first engagement part D1 closely touch two sidewalls of the casing A0, and the limit spring sheet A1 stops the top surface of the first engagement part D1, so that the DP plug D0 could be positioned inside the connector socket. When the second engagement part E1 is inserted into the accommodating room C0 of the connector socket, a sidewall of the second engagement part E1 closely touches one of the two sidewalls of the casing A0, another sidewall of the second engagement part E1 leans against the limit spring sheet A1, so that the HDMI plug E0 could be positioned inside the connector socket.

The disadvantages of the connector socket are as follows:

1. When the DP plug is inserted into the accommodating room of the casing, the two sidewalls of the first engagement part touch closely the two sidewalls of the casing, and the limit spring sheet stops the top surface of the first engagement part and is movable upwards. When the first engagement part is inserted aslant or the limit spring sheet is stirred excessively by users, because there is no stop structure above the limit spring sheet for stopping it, it is easy for the limit spring sheet to be deflected exceedingly upwards or deformed seriously to lose the limit function.

2. When the HDMI plug is inserted into the accommodating room of the casing, one of the two sidewalls of the second engagement part touches closely one of the two sidewalls of the casing, the other sidewall of the second engagement part leans against the limit spring sheet, and because the width of the second engagement part is narrower than that of the opening, the limit spring sheet could move toward a neighbor sidewall of the casing, and there is no stop structure to stop it. When the second engagement part is inserted aslant, the limit spring sheet is loaded with larger force so that the limit spring sheet is excessively deflected or seriously deformed toward the neighbor sidewall of the casing to lose the limit function.

Therefore, there is a need to design a new connector socket to solve the above disadvantages.

SUMMARY OF THE INVENTION

A purpose of the invention is to provide a connector socket, which could prevent or avoid excessive deformation of a elastic device by the effect of stopping and leaning-against of a metal casing so that two plugs with different widths could be engaged with the connector socket well.

To achieve the above purpose, the connector socket of the invention adopts the following scheme:

A connector socket, for engaging with a first plug and a second plug with different widths, includes an insulation base, a metal casing, and an elastic device. The metal casing embraces the insulation base. A first engagement space and a second engagement space being defined. The first plug occupies the first engagement space after entering the metal casing. The second plug occupies the first engagement space and the second engagement space after entering the metal casing. The elastic device includes a mounted part and a leaning part. The mounted part is mounted in the insulation base. The leaning part extends form the mounted part into the second engagement space. A top sidewall of the metal casing stops the leaning part when the leaning part moves upwards to a certain position. When the first plug enters the first engagement space, the leaning part leans against a side of the first plug close to the second engagement space. When the second plug enters the first engagement space and the second engagement space, the leaning part leans against a top surface of the second plug.

Compared with the prior art, the elastic device is mounted in the insulation base. When the first plug enters the first engagement space, the side of the first plug close to the second engagement space presses the elastic device to move to a proper position, and the metal casing stops the elastic device for preventing or avoiding that the elastic device exceeds the elastic limit thereof to be deformed. When the second plug enters the first engagement space and the second engagement space, and the leaning part moves upwards to a certain position, the top sidewall of the metal casing stops the leaning part for preventing or avoiding that the elastic device exceeds the elastic limit thereof to be deformed.

By the effect of stopping and leaning-against of the metal casing to the elastic device at two directions, the deformation over the elastic limit of the elastic device is prevented or avoided so that the two plugs with different widths could be engaged with the connector socket well so as to enhance the engagement effect.

The advantage and spirit of the invention may be understood by the following recitations together with the appended drawings.

BRIEF DESCRIPTION OF THE APPENDED DRAWINGS

DETAILED DESCRIPTION OF THE INVENTION

In order to understand the purpose, structure, characteristic, and effect of the invention well, the connector socket of the invention is to be further explained in combination with the following embodiments and appended drawings.

Figure 1:
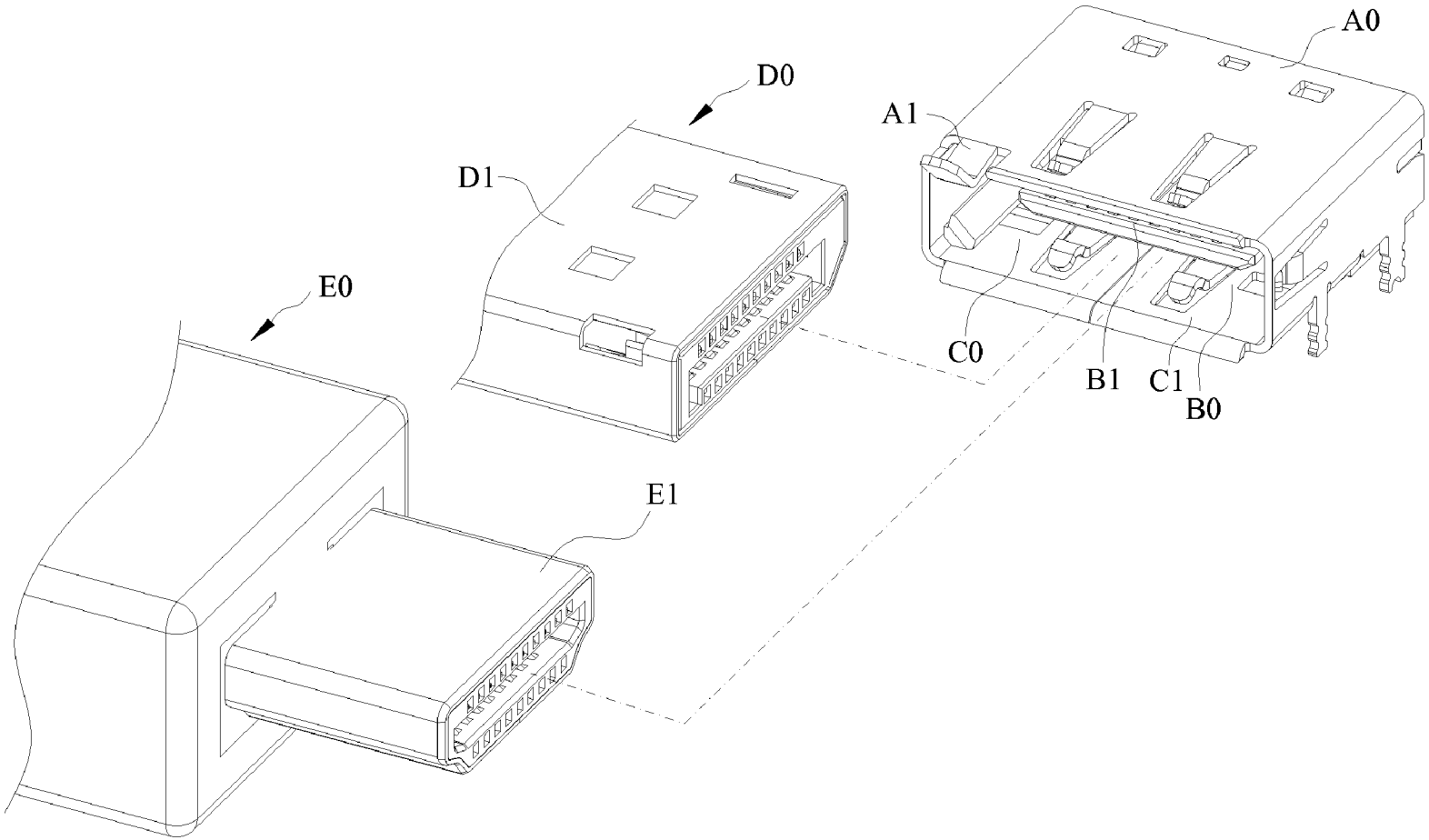
FIG. 1 (prior art)
FIG. 1 is an exploded drawing of a connector socket in the prior art and two plugs in coordination therewith.
Figure 2:
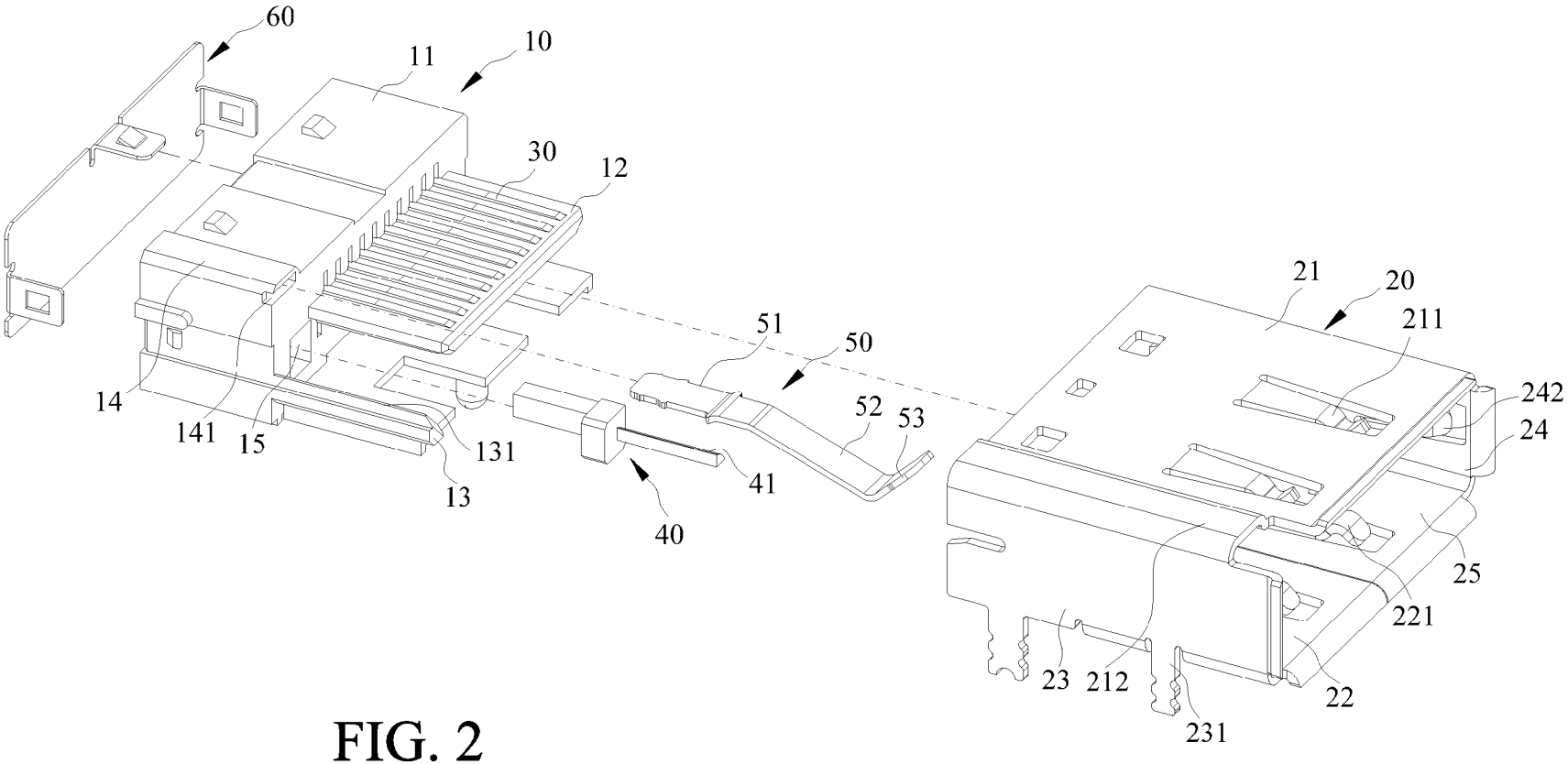
FIG. 2 is an exploded drawing of a connector socket according to the invention.

Please refer to FIG. 2. The connector socket of the invention includes an insulation base 10, a metal casing 20 embracing the insulation base 10, a plurality of terminals 30 accommodated in the insulation base 10 respectively, a positioning part 40 partially mounted in the insulation base 10, an elastic device 50 partially mounted in the insulation base 10, and a shield sheet 60 disposed at the rear end of the insulation base 10 and adapted to the metal casing 20.

The insulation base 10 includes a base portion 11, a tongue plate 12 extending forwards from the base portion 11, a fool-proof device 13 extending forwards from the low-left side of the base portion 11, a protrusion 14 disposed at the left side of the top surface of the base portion 11 with a positioning slot 141 inside, and a blind hole 15 formed at the side of the base portion 11 near the tongue plate 12. The fool-proof device 13 is a long column for a preferred embodiment and has an oblique surface 131 formed at the side of the fool-proof device 13 toward the tongue plate 12.

Figure 3:
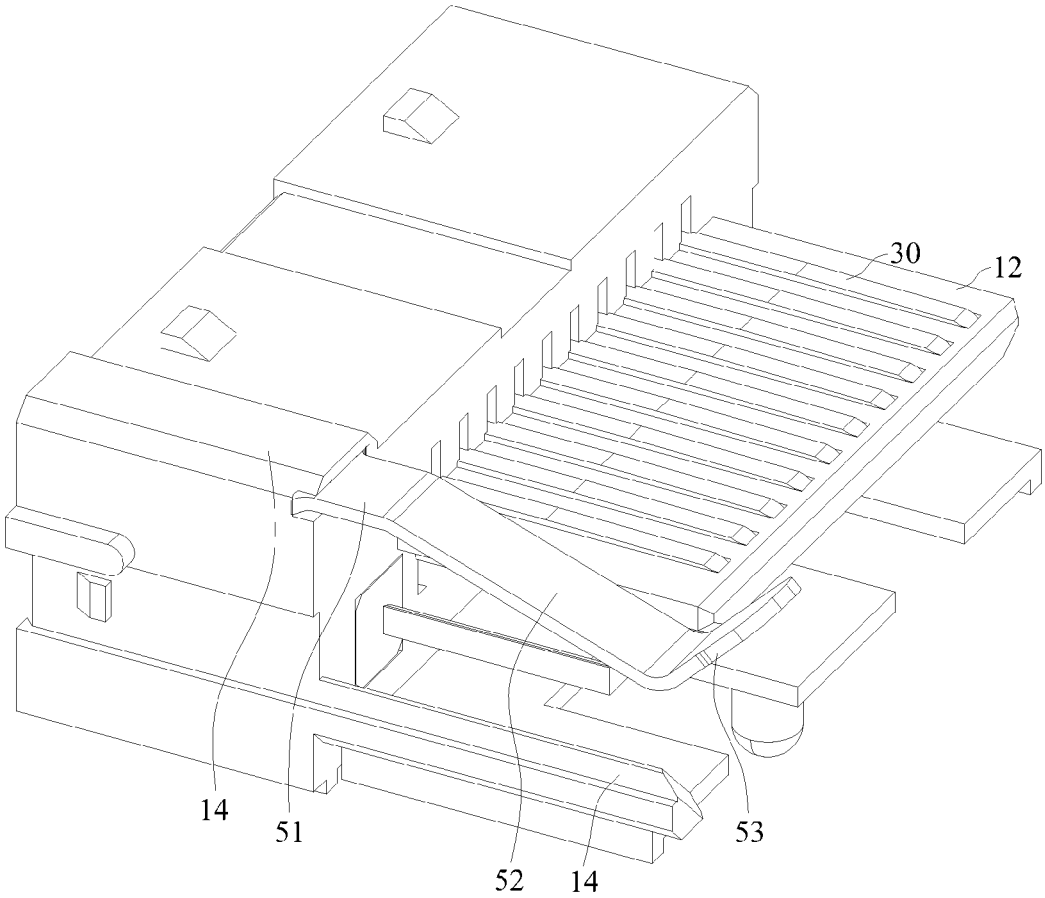
FIG. 3 is an assembly drawing of an elastic device and an insulation base according to the invention.
Figure 4:
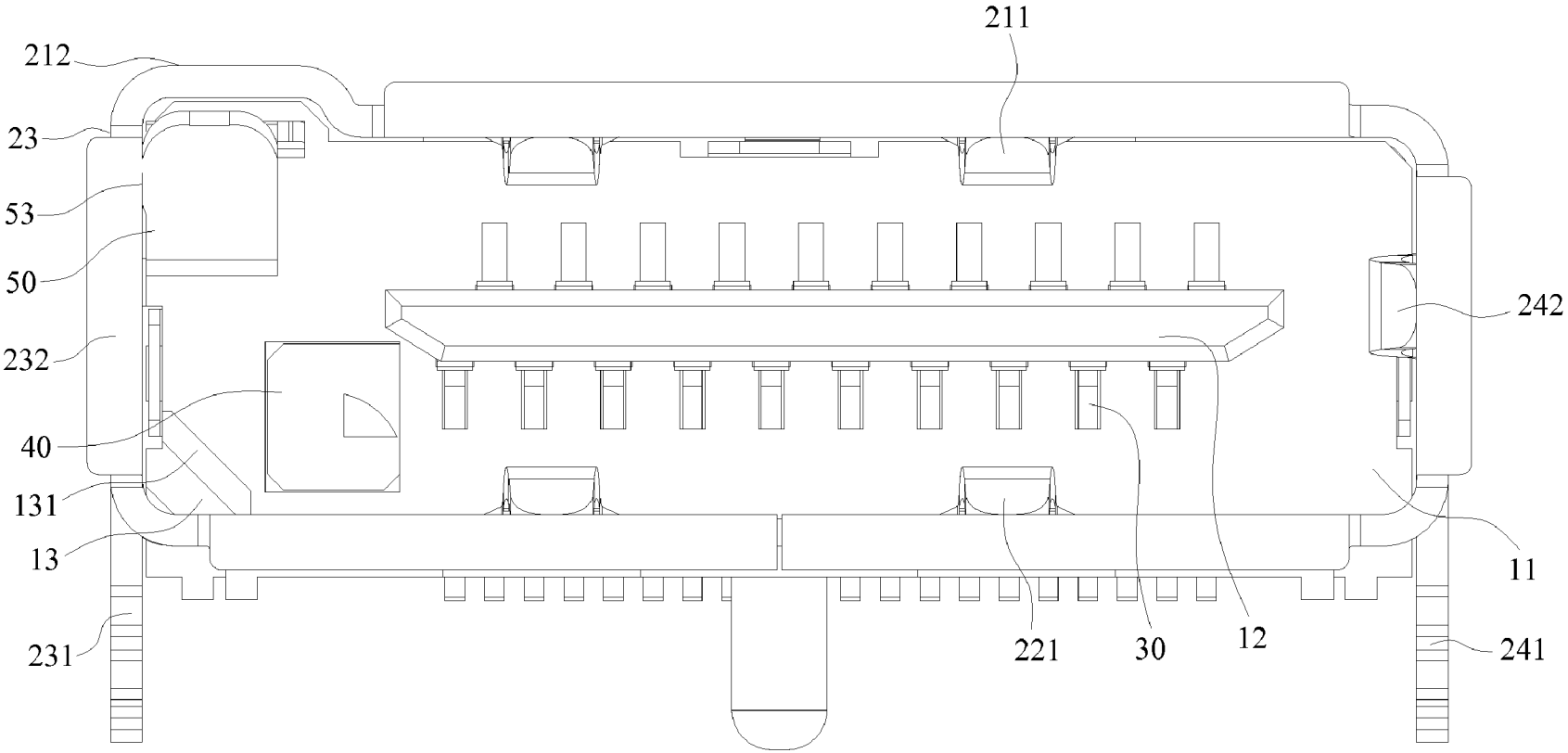
FIG. 4 is a front view of the connector socket according to the invention.
Figure 5:
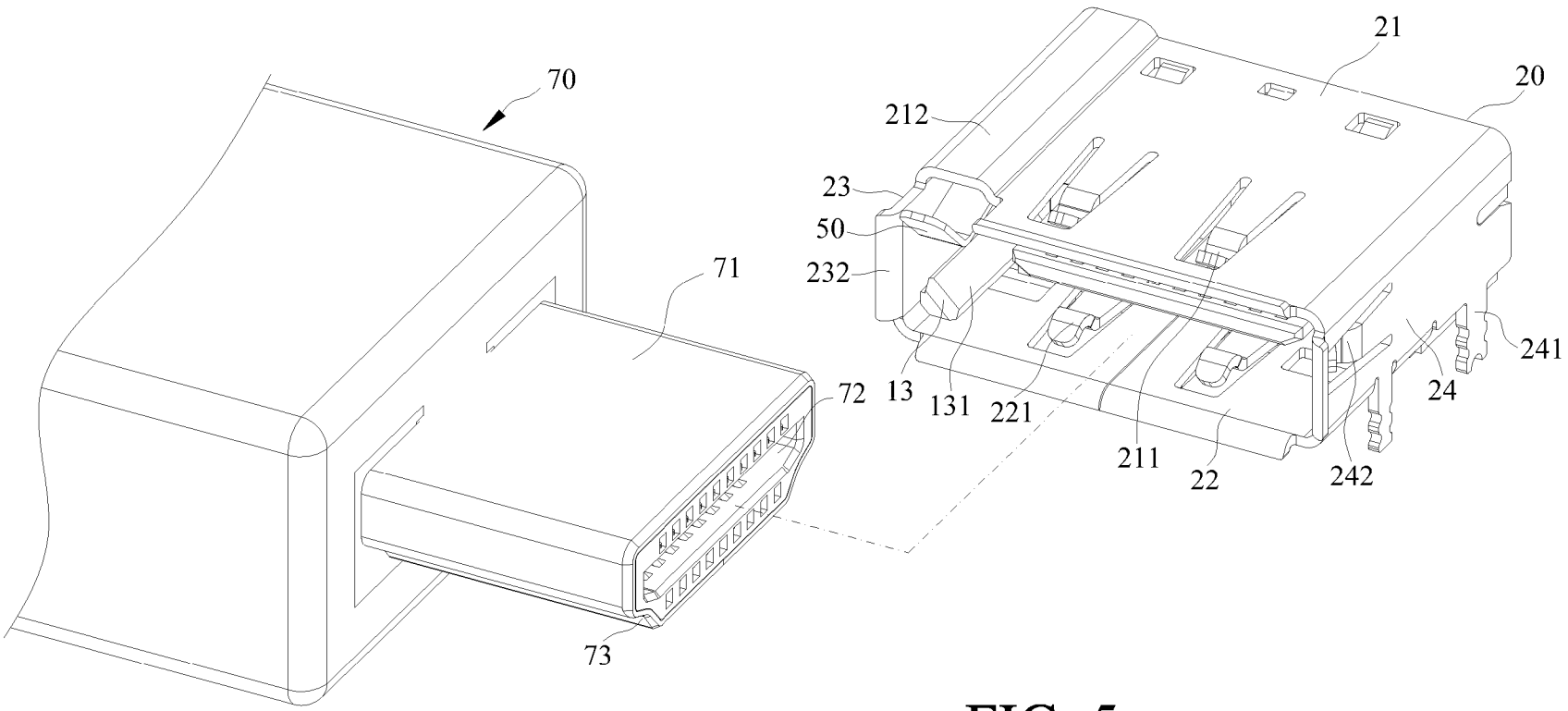
FIG. 5 is an assembly drawing of a plug and the connector socket according to the invention.
Figure 6:
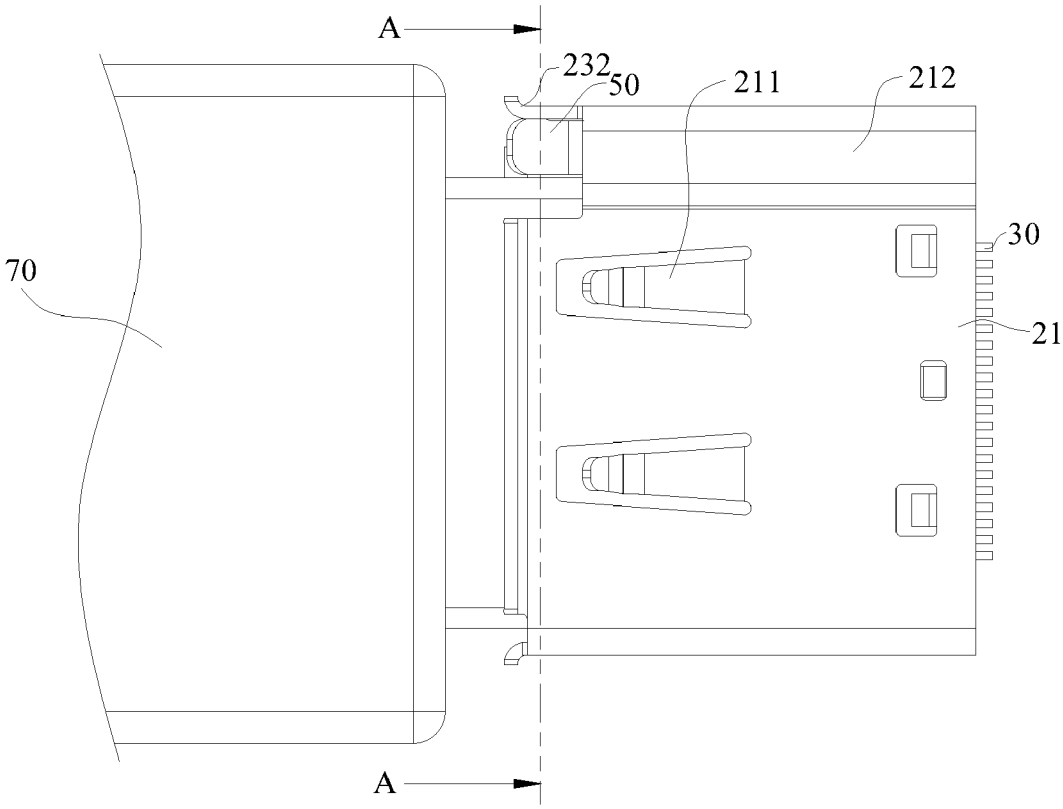
FIG. 6 is a top view of the assembly of a plug and the connector socket according to the invention.
Figure 7:
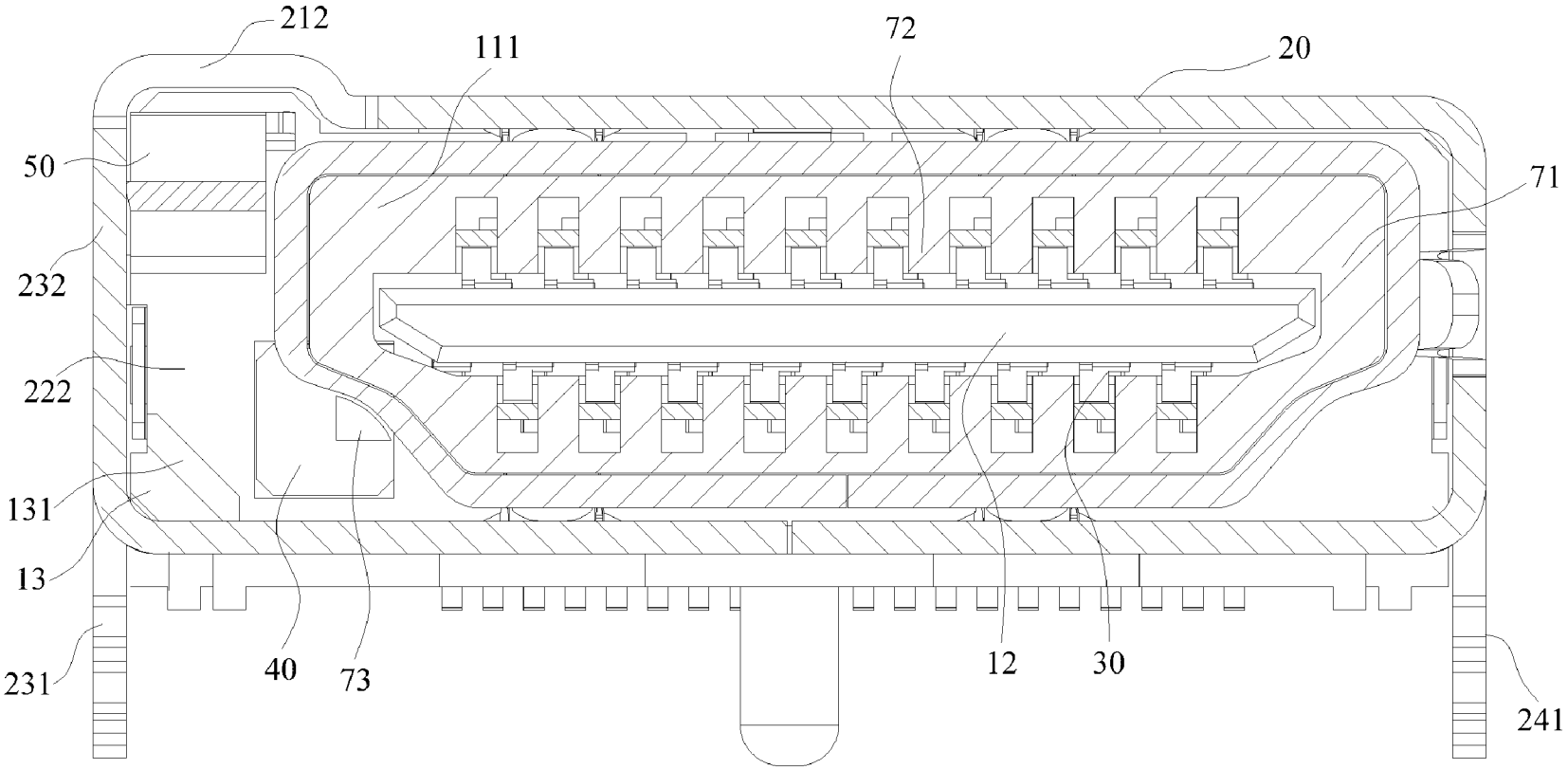
FIG. 7 is a cross-section drawing of FIG. 6 taken along lines A-A in FIG. 6.
Figure 8:
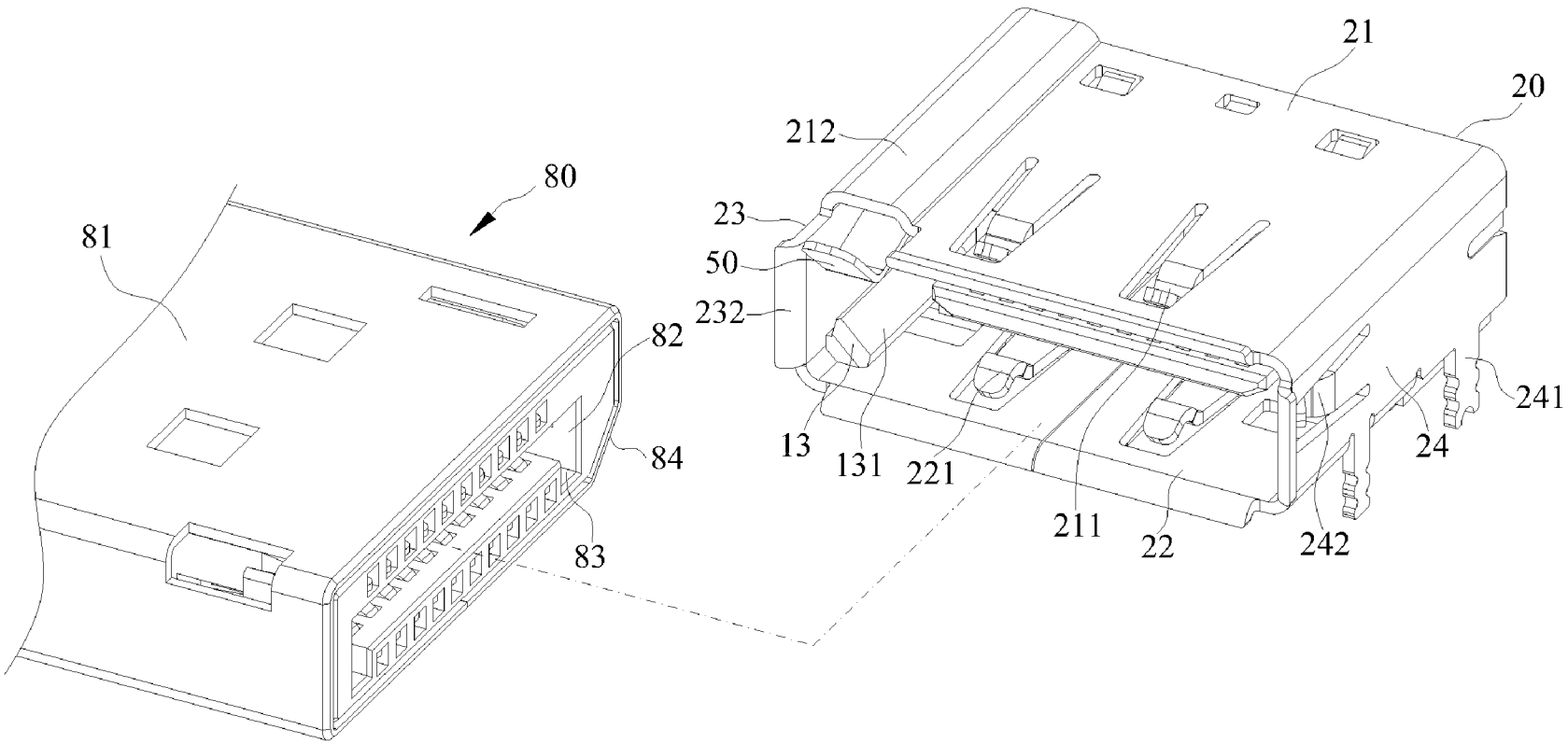
FIG. 8 is an assembly drawing of another plug and the connector socket according to the invention.
Figure 9:
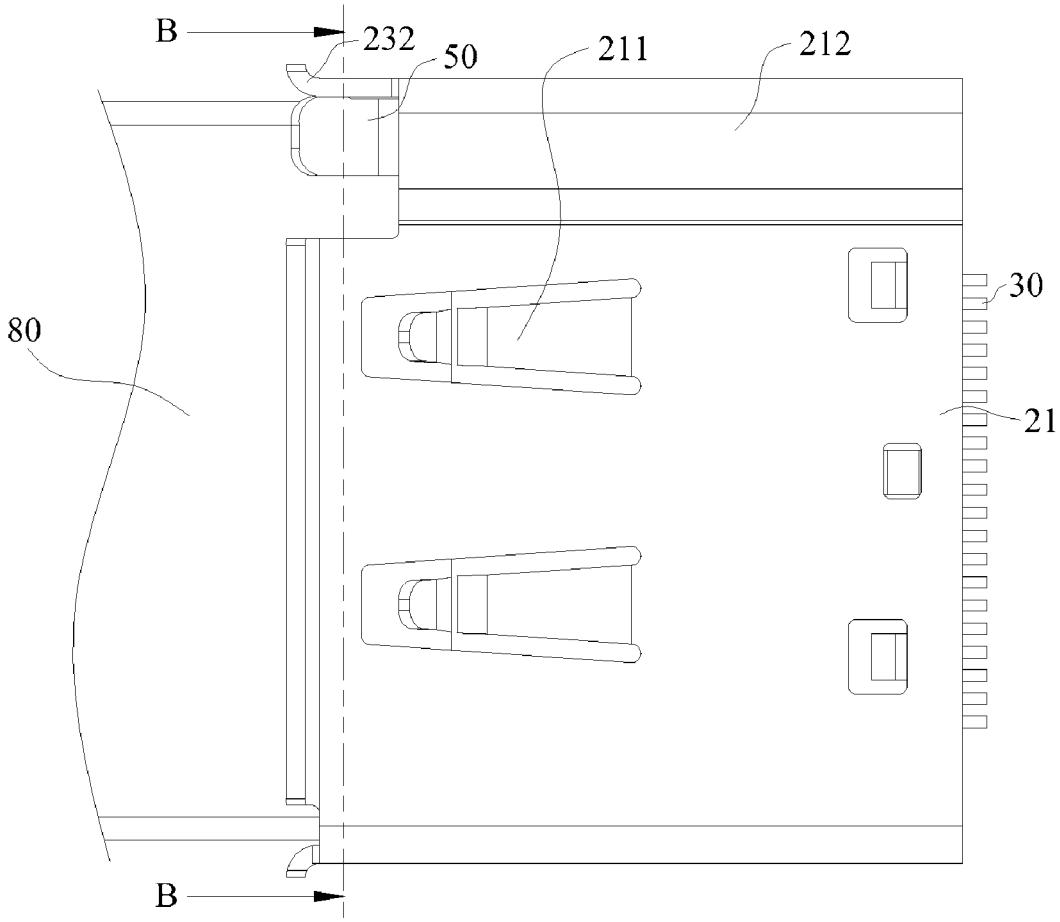
FIG. 9 is a top view of the assembly of another plug and the connector socket according to the invention.
Figure 10:
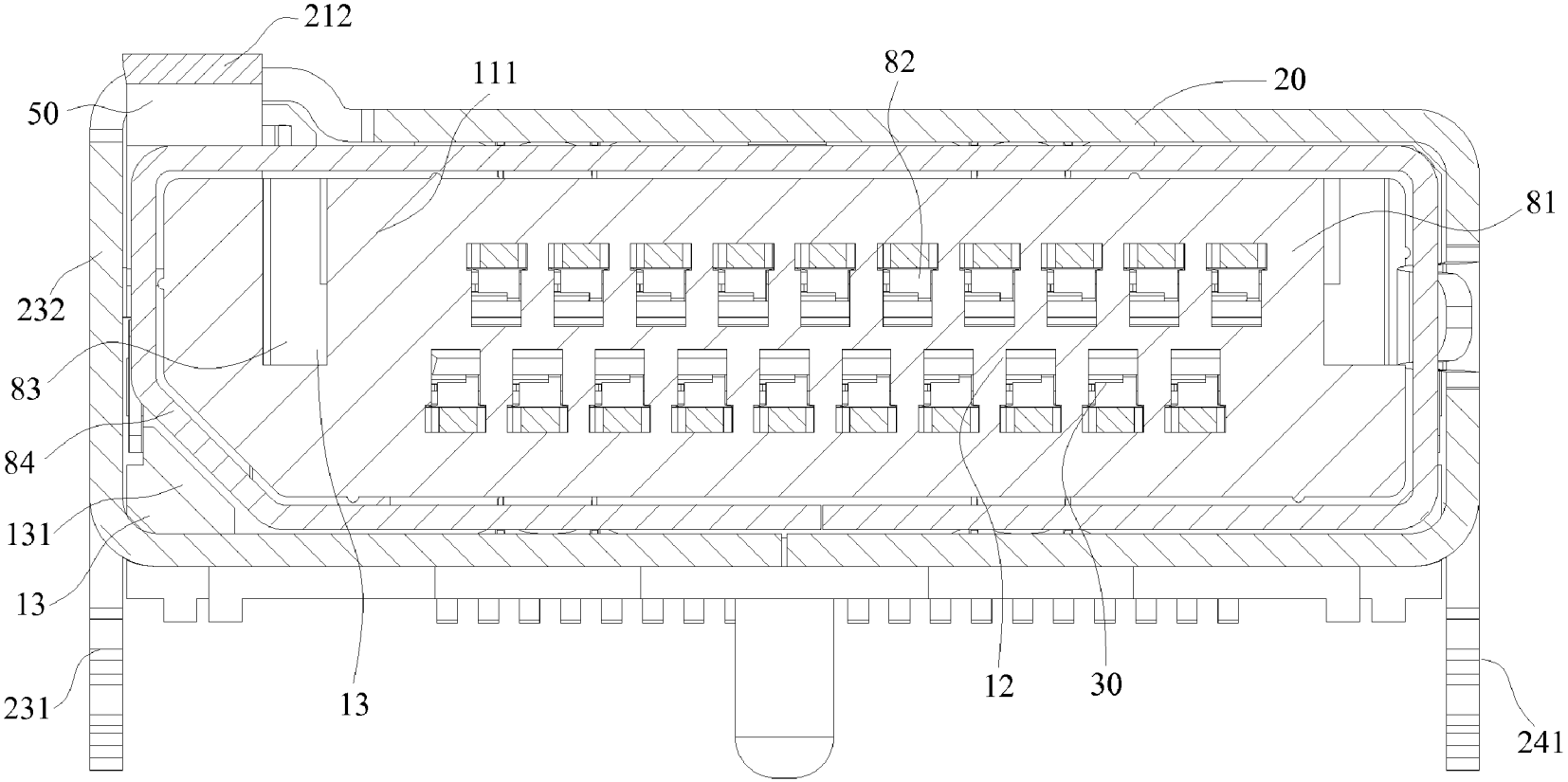
FIG. 10 is a cross-section drawing of FIG. 9 taken along lines B-B in FIG. 9.

Please refer to FIGS. 2, 3 and 4. The metal casing 20 is hollow and has a top sidewall 21 and a bottom sidewall 22 disposed oppositely, a left sidewall 23 and a right sidewall 24 disposed oppositely, and several fixing sheets 231, 241 extending downwards from the left sidewall 23 and the right sidewall 24 respectively and mounted on a circuit board. The top sidewall 21, the bottom sidewall 22, the left sidewall 23, and the right sidewall 24 together form an accommodating space. The accommodating space has an opening 25. The top sidewall 21 and the bottom sidewall 22 are respectively pressed to form two pressing parts 211, 221 protruding into the accommodating space. The left sidewall 23 is bent to form a stop part 232 at the opening 25. The right sidewall 24 is cut to form an elastic locking part 242 toward the left sidewall 23. The metal casing 20 has a raised portion 212 upward disposed at the top sidewall 21 near the left sidewall 23. The raised portion 212 is used for accommodating the protrusion 14. The insulation base 10 is sleeved into the accommodating space. The insulation base 10 is fitted closely with the circumference of the metal casing 20.

The terminals 30 are positioned in the base portion 11 first and extend into the tongue plate 12.

An end of the positioning part 40 is mounted in the insulation base 10, and another end thereof extends from the blind hole 15 of the base portion 11 into the accommodating space. The positioning part 40 has a leaning surface 41 at the end of the positioning part 40 into the accommodating space.

The elastic device 50 includes a mounted part 51 mounted in the insulation base 10 and a leaning part 52. The leaning part 52 is formed to be a curve part by bending downwards from the mounted part 51. The mounted part 51 is mounted in the positioning slot 141. A tail end of the leaning part 52 has a width portion 53 leaning against the left sidewall 23. However, in other embodiments, the leaning part 52 could be without the width portion 53. The elastic device 50 is inserted in the positioning slot 141 in the protrusion 14, so that the mounted part 51 is mounted in the positioning slot 141 and the leaning part 52 extends into the accommodating space.

The shield sheet 60 is disposed at the rear end of the insulation base 10 and locks with the metal casing 20.

Please refer to FIGS. 5-10. For operation, the connector socket is used for engaging with a first plug and a second plug with different widths. In this embodiment, the first plug is a high definition multimedia interface ("HDMI" for short hereinafter) plug 70. The second plug is a display port ("DP" for short hereinafter) plug 80. The HDMI plug 70 and the DP plug 80 includes a first engagement part 71 and a second engagement 81 respectively. The width of the first engagement part 71 is narrower than that of the second engagement part 81.

When the HDMI plug 70 slides into the accommodating space, a first engagement space 111 is defined and occupied by the HDMI plug 70. The tongue plate 12 is capable of being engaged with a first engagement hole 72 of the first engagement 71. The width portion 53 leans against the left sidewall 23. Because the outer size of the first engagement part 71 is smaller than the hole size of the opening 25, a side of the elastic device 50 leans against the left sidewall of the first engagement part 71 to prevent the movement of the first engagement part 71 toward the elastic device 50 for sure that the first engagement part 71 is positioned well in the accommodating space of the metal casing 20. At this moment, the HDMI plug 70 is engaged with the connector socket more tightly under the limit effect by the positioning part 40 lying at the recess portion 73 with the leaning surface 41 of the positioning part 40 corresponding to the outer surface of the first engagement part 71, and the pressing parts 211, 221 and the locking part 242 coordinating with the positioning part 40 and the elastic device 50.

When the DP plug 80 slides into the accommodating space, a second engagement space 222 is defined and occupied together with the first engagement space 111 by the DP plug 80. The tongue plate 12 enters a second engagement hole 82 of the second engagement part 81. The oblique surface 131 leans against an oblique portion 84. At this moment, the positioning part 40 is inserted into a sunken accommodating slot 83. The terminals 30 on the tongue plate 12 and terminals disposed in the second engagement hole 82 contact and connect each other. The stop part 232 limits the DP plug 80 for preventing excessive shift thereof. The leaning part 52 leans against the top surface of the second engagement part 81. When the leaning part 52 moves upwards to a certain position, the raised portion 212 stops the leaning part 52. Under the limit effect by the pressing parts 211, 221 and the locking part 242 coordinating with the positioning part 40 and elastic device 50, the DP plug 80 is engaged with the connector socket more tightly, which improves the engagement.

As discussed above, the connector socket of the invention has the following advantages:

1. The HDMI plug is inserted into the first engagement space. A sidewall of the HDMI plug touches closely the right sidewall of the metal casing, and another sidewall thereof leans against the elastic device. The width of the first engagement part is smaller than the hole size of the opening. The elastic device could move toward the adjacent left sidewall of the metal casing. Because the elastic device is disposed in the insulation base, when the first engagement part is engaged aslant or the elastic device is stirred excessively by users, the leaning part would be stopped by the sidewall of the metal casing for preventing or avoiding the excessive deflection or serious deformation on the elastic device to affect the limit function and the engagement.

2. The DP plug is inserted into the first engagement space and the second engagement space. When the second engagement part is engaged aslant or the elastic device is stirred excessively by users, because there is a stop structure, the raised portion, above the elastic device stopping the elastic device, the excessive deflection upwards or serious deformation could be prevented or avoided so as to maintain the limit function and improve the engagement.

3. When the HDMI plug is inserted into the first engagement space, the positioning part lies at the recess portion with the leaning surface of the positioning part corresponding to the outer surface of the first engagement part. Thereby, further coordinating with the pressing parts and the locking part of the metal casing, the HDMI plug is engaged with the connector socket more tightly and the engagement is more firm.

4. There is the stop part disposed at the front of the sidewall of the metal casing near the elastic device. When the DP plug is inserted into the first engagement space and the second engagement space, the leaning part of the elastic device leans against the top surface of the second engagement part. At this moment, the stop part stops the elastic device from inclining.

With the example and explanations above, the features and spirits of the invention will be hopefully well described. Those skilled in the art will readily observe that numerous modifications and alterations of the device may be made while retaining the features and spirits of the invention. Accordingly, the above disclosure should be construed as limited only by the metes and bounds of the appended claims.

What is claimed is:

1. A connector socket, for engaging with a first plug and a second plug with different widths, the connector socket comprising:

an insulation base;

a metal casing, embracing the insulation base, a first engagement space and a second engagement space being defined, the first plug occupying the first engagement space after entering the metal casing, the second plug occupying the first engagement space and the second engagement space after entering the metal casing; and an elastic device, comprising a mounted part and a leaning part, the mounted part being mounted in the insulation base, the leaning part extending form the mounted part into the second engagement space, a top sidewall of the metal casing stopping the leaning part when the leaning part moves upwards to a certain position;

wherein when the first plug enters the first engagement space, the leaning part leans against a side of the first plug close to the second engagement space, and when the second plug enters the first engagement space and the second engagement space, the leaning part leans against a top surface of the second plug.

2. The connector socket of claim 1, wherein a side of the leaning part away from the first engagement space leans against a sidewall of the metal casing.

3. The connector socket of claim 2, wherein a tail end of the leaning part has a width portion, and a side of the width portion away from the first engagement space leans against the sidewall of the metal casing.

4. The connector socket of claim 1, wherein the leaning part of the elastic device is formed to be a curve part by bending downwards from the mounted part, for leaning against the top surface of the second plug.

5. The connector socket of claim 1, wherein the insulation base comprises a protrusion protruding upward, the protrusion comprises a positioning slot, the elastic device is mounted in the positioning slot, and the metal casing comprises a raised portion according to the protrusion for accommodating the protrusion.

6. The connector socket of claim 1, wherein the first plug is a high definition multimedia interface plug, the second plug is a display port plug, the first plug and the second plug correspondingly comprise a first engagement part and a second engagement part respectively, when the first plug enters the first engagement space, a gap exists between a sidewall of the first plug and a sidewall of the metal casing away from the first engagement space, and the gap is the second engagement space.

7. The connector socket of claim 1, wherein the metal casing comprises a stop part at a front of sidewall of the metal casing close to the elastic device, and when the second plug enters the first engagement space and the second engagement space, the leaning part of the elastic device leans against the top surface of the second plug and the stop part stop the elastic device from inclining.

8. The connector socket of claim 1, wherein at least one pressing part is disposed at the top sidewall and the bottom sidewall of the metal casing respectively, and when the first plug or the second plug enters the first engagement space, the two pressing parts press a top surface and a bottom surface respectively of the first plug or the second plug.

9. The connector socket of claim 1, wherein a locking part is disposed toward the first engagement space at a sidewall of the metal casing away from the second engagement space, and when the first plug or the second plug enters the first engagement space, the locking part locks a side surface of the first plug or the second plug.

* * * * *